United States Patent [19]

McCormick

[11] 3,994,116

[45] Nov. 30, 1976

[54] BALE WRAPPING PROCESS

[75] Inventor: Robert Milton McCormick, Columbia, S.C.

[73] Assignee: E. I. Du Pont de Nemours and Company, Wilmington, Del.

[22] Filed: Mar. 5, 1975

[21] Appl. No.: 555,446

[52] U.S. Cl. ..... 53/32; 53/228

[51] Int. Cl.[2] ..... B65B 11/16

[58] Field of Search ..... 53/32, 33, 139, 228, 53/229, 230, 231, 232, 233

[56] References Cited

UNITED STATES PATENTS

| | | | |
|---|---|---|---|
| 1,443,068 | 1/1923 | Conley | 53/228 X |
| 2,152,323 | 3/1939 | Moore | 53/33 X |
| 2,262,774 | 11/1941 | Neumair | 53/33 X |
| 2,378,920 | 6/1945 | Gillican | 53/139 X |
| 3,158,973 | 12/1964 | Monaghan | 53/233 X |
| 3,191,356 | 6/1965 | Zelnick | 53/229 X |
| 3,564,810 | 2/1971 | Faletti | 53/33 |
| 3,589,100 | 6/1971 | Konars | 53/229 X |
| 3,643,396 | 2/1972 | Togashi | 53/229 X |
| 3,739,547 | 6/1973 | Brevko | 53/230 X |

*Primary Examiner*—Travis S. McGehee
*Assistant Examiner*—J. Sipos

[57] ABSTRACT

A novel bale-wrapping process provides bales of superior appearance and greater durability to shipping conditions and involves wrapping a strapped bale with a nonwoven fabric that is then sewn to snugly fit the gross contours of the bale.

2 Claims, 7 Drawing Figures

BALE WRAPPING PROCESS

BACKGROUND OF THE INVENTION

This invention relates to the packaging of bales of fibrous material and, more particularly, the invention relates to the covering of the bale with flexible sheeting.

Compression baling of staple fibers is known in the art and covers to protect the bales during shipping and handling have been fashioned from a variety of materials including burlap, cardboard, nonwoven fabrics and plastic films. The first three materials have generally been strapped onto the bale with compression-retaining straps. It is known to heat seal plastic film or sew it onto a strapped bale and, optionally, to heat-shrink it into close conformity to the bale contours. It is also known to strap nude (unwrapped) bales, wrap and then add straps merely to retain the wrapper.

All of the methods and materials employed have suffered from some inadequacies: overstrapped, cardboard-wrapped bales are expensive and difficult to adjust to varying bale sizes. Plastic films have relatively low tear strength and are vulnerable to snags if loose or to puncturing if heat-shrunk to taut conformity to the bale. Sewn, nonwoven fabric covers overcome most of these disadvantages, but means have not been available to fashion a cover which is both neat and durable. Such a cover is desirable.

SUMMARY OF THE INVENTION

The inadequacies of available bale-wrapping processes are largely overcome in a novel process for wrapping of bales that, in one embodiment, comprises wrapping with two parallel sheets of nonwoven fabric, clamping the fabrics together to snug them around the bale, leaving extending fabric flanges on opposite bale sides, sewing the flanges together snugly against the bale sides to form a closely fitting tube with open ends extending beyond opposite ends of the bale sufficiently to permit slight overlap when tucked inwardly, tucking opposite sides of the extending tube lengths against the opposite ends of the bale, folding together, to form extending flanges, the remaining, opposing tube sides and sewing the flanges snugly against the opposite ends of the bale to complete the closure.

DETAILED DESCRIPTION OF THE ILLUSTRATED EMBODIMENTS

Figure 2:
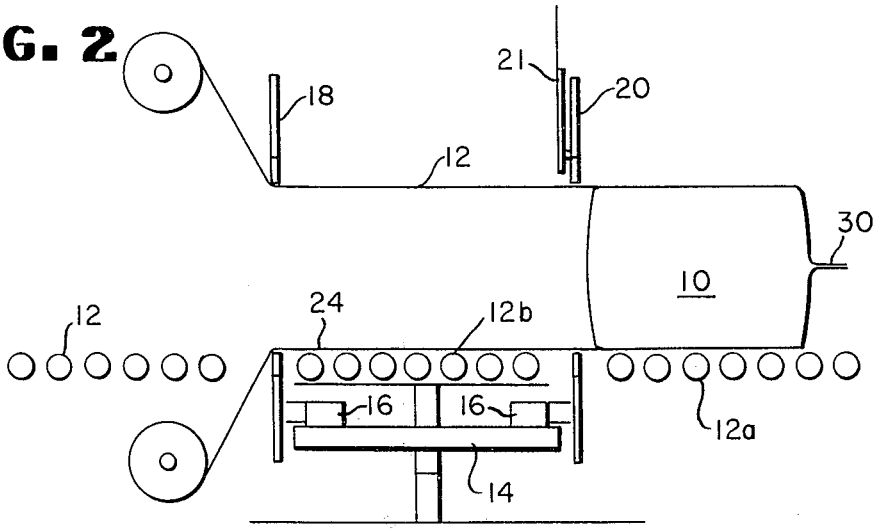
Figure 3:
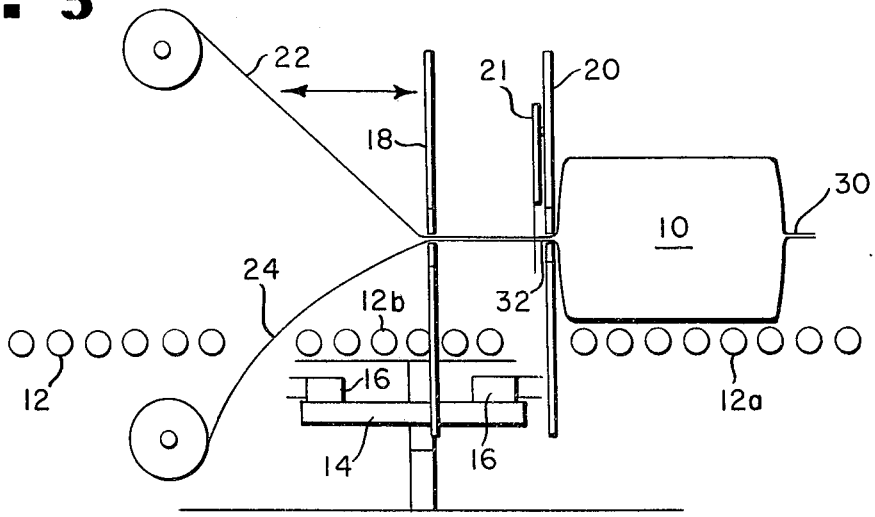

Referring to the drawings, the wrapping device chosen for purposes of illustration includes a conveyor having fixed sections **12, 12*a*, with a section 12*b* between them that is mounted on a platform 14 movable in the vertical direction. The platform 14 also supports two railway sewing machines designated 16 which are capable of movement in a direction perpendicular to the drawing along the platform 14. Two clamps 18, 20 are positioned between conveyor sections 12, 12*a*. The clamps are capable of opening to permit passage of bale 10 therethrough (FIG. 2) and of closing to clamp the wrapping fabrics 22, 24 together. Clamp 18 also has the capability to move toward and away from clamp 20 as indicated by its position and the direction arrow shown in FIG. 3. A cutter 21 is mounted on clamp 20 for cutting clamped together sections of fabric 22, 24 (FIG. 3**).

Figure 1:
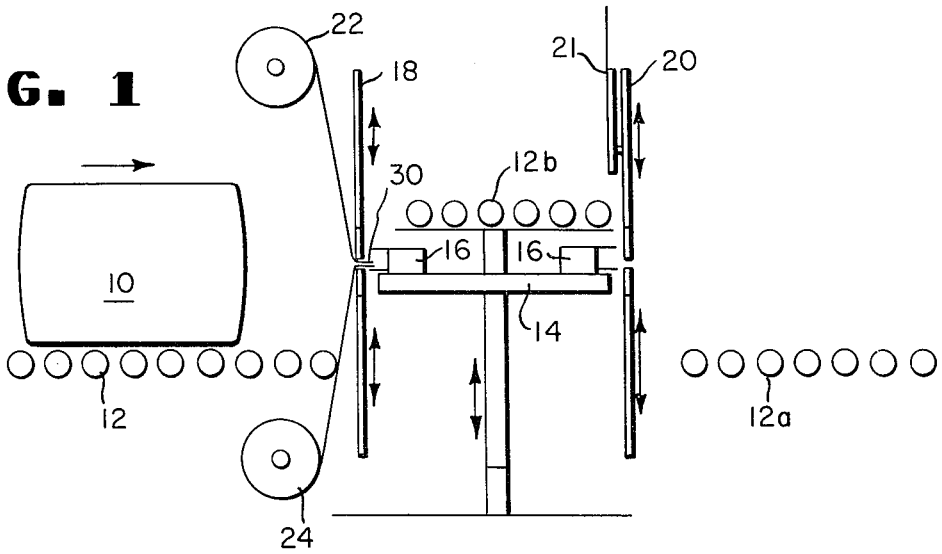
FIGS. 1–4 are schematic elevation views illustrative of the bale wrapping steps in forming the sewn tube in one embodiment.
Figure 4:
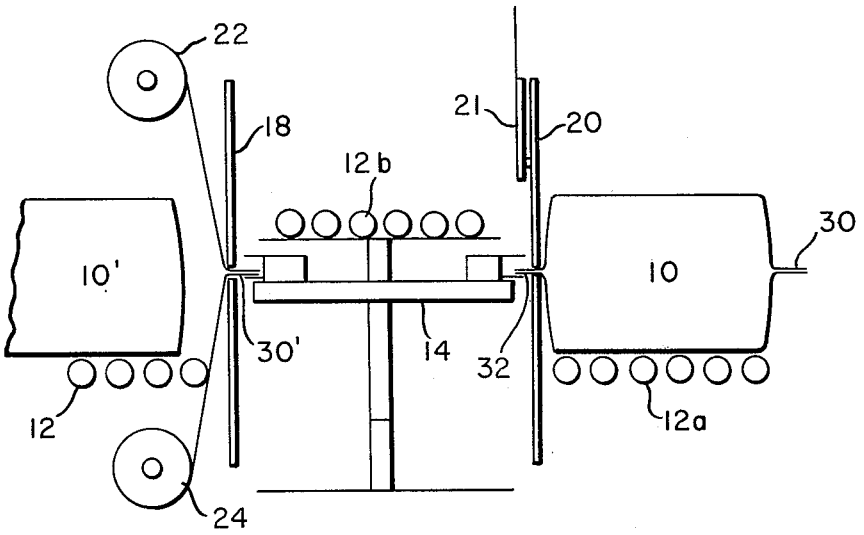

In operation, fabrics 22, 24 from their respective rolls are held in clamp 18 and are sewn together to form a flange 30 as bale 10 moves along conveyor section 12 (FIG. 1). Platform 14 and conveyor **12*b* are dropped to align the three conveyors 12, 12*a* and 12*b* and clamps 18 and 20 are opened to permit bale 10 to pass to its wrapping station on conveyor section 12*a*. As the bale 10 moves to its wrapping station, tension is applied to the fabric 22, 24 by means not shown, to keep the fabric snug against the leading side of the bale (FIG. 2). Next, clamp 18 is moved toward clamp 20 and then the clamps are closed while tension is maintained on the fabric to assure a snug wrap around all sides of the bale 10. The fabric is cut by device 21 to leave a sewable flange 32 upstream of clamp 20 (FIG. 3). The fabric ends held in clamp 18 are moved with the clamp back to its starting position, platform 14 is raised and another bale 10′ is moved onto conveyor 12 to begin the wrapping process after the simultaneous sewing of flanges 32 and 30′ is accomplished by sewing machines 16 (FIG. 4). Upon completion of the sewing of flanges 30′ and 32, clamps 18 and 20 are opened releasing bale 10** for movement to an end closing station.

Figure 5:
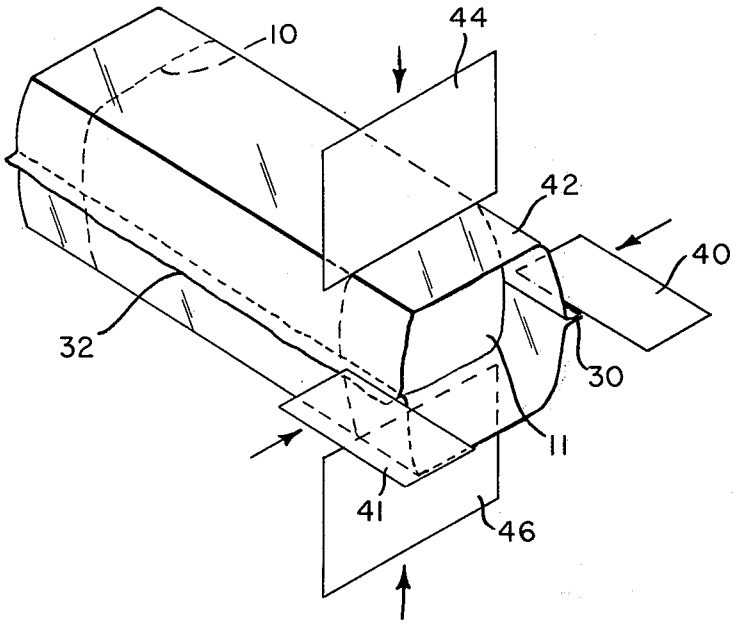
FIG. 5 schematically illustrates in perspective view the tucking and folding steps for an end closure of the illustrated embodiments.

The operation of the end closing station is illustrated by reference to FIG. 5 in which tucking plates 40, 41 are moved together to tuck inwardly the flanged sides of open end 42 which extend beyond the end 11 of the bale 10. While holding the side tucks in place, folding plates 44, 46 are brought together completing the end closure with an end flange extending out from the end of the bale which is sewn together to lock the closure. The bale is then reversed and the tucking, folding and sewing operations are repeated to close the opposite end. Alternatively, both ends may be closed simultaneously with duplicate equipment.

Figure 6:
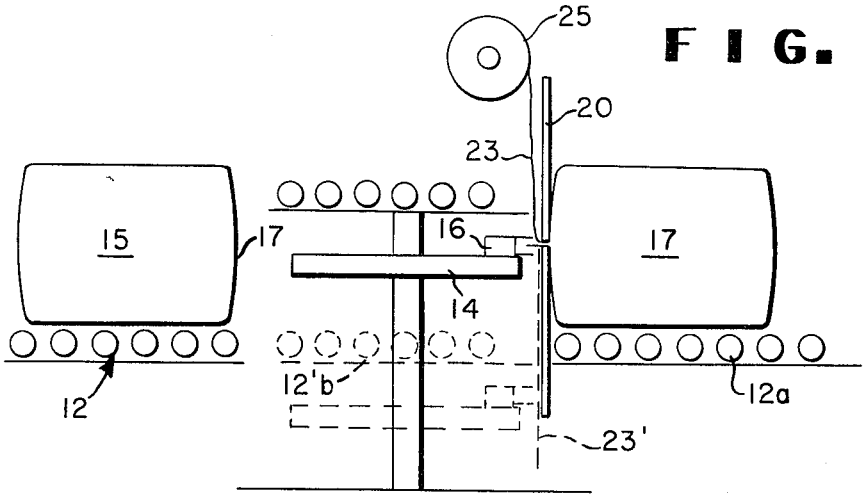
FIG. 6 illustrates the initial bale wrapping step of the illustrated alternative embodiment.
Figure 7:
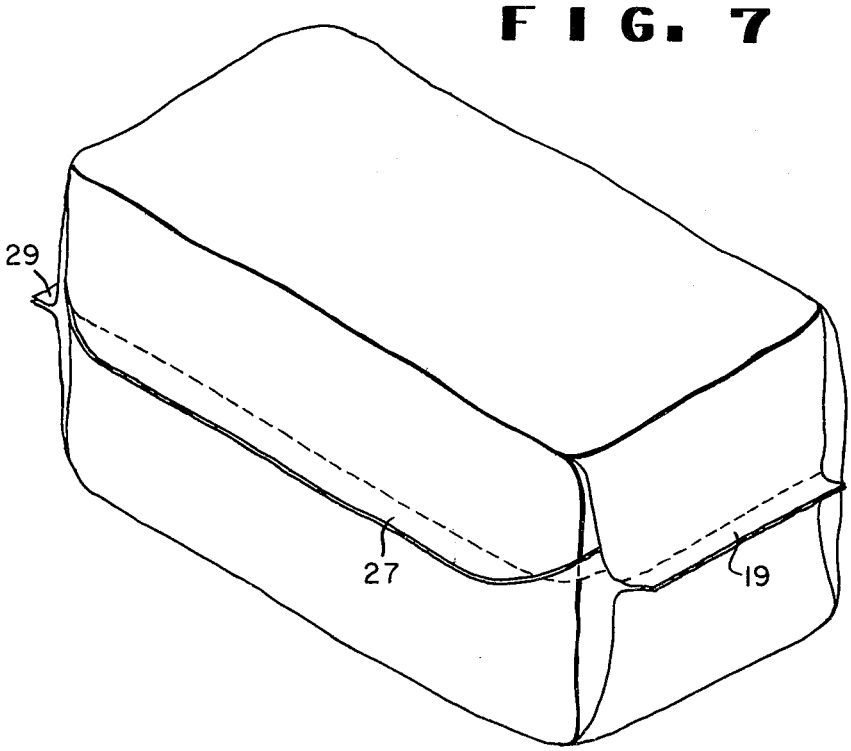
FIG. 7 schematically illustrates, in perspective view, the appearance of a bale wrapped in accordance with the illustrated embodiment of FIG. 6.

An alternate embodiment requires sewing along only three rather than four faces of the bale by using a single length of fabric as described in conjunction with FIGS. 6 and 7.

Referring now to FIG. 6, strapped bale 15 rests on conveyor 12. Fabric 23 has been drawn from roll 25 and its extended position 23′ to form an open ended tube around four sides or faces of bale 17. This is accomplished by movement of bale 17 from conveyor 12 to conveyor **12*a*. Clamp 20 holds together the formerly extended end 23′ and the supply end of fabric from roll 25 to form a flange 27. The supply end is cut off by means not shown. Platform 14 is raised, and flange 27 (with reference to FIG. 7) is sewn by sewing machine 16 to form a tight tube around four sides of the bale. The sides of the open tube extending over the remaining faces of the bale are tucked, folded and sewn as described above in reference to FIG. 5 to form flanges 29 and 19. A narrower fabric would be required if a bale end rather than side were advanced toward fabric 23 to form a wrapped bale having flanges at, with reference to FIGS. 7, 27, 19 and side opposite 27 but not at 29.**

Fabric from roll 25 is drawn past the conveyor by means not shown to the position indicated by extended end 23'. Platform 14 is lowered to the dotted line position to align conveyor 12 with conveyors 12*a* and 12*b*. Bale 15 is advanced to the position occupied by bale 17, drawing around itself fabric from roll 25 and that extended to position 23'. Clamp 20 is closed on the free ends of the fabric and platform 14 is raised to operating position to complete the cycle.

This invention has been illustrated by use of a single type of wrapper and a single means of closing the unique flanges. It will be obvious, however, that many materials are suitable for use as a wrapper, including foils, films, papers and a variety of nonwoven fabrics consolidated by resin bonding, needling, etc. The outwardly extending flange is also well adapted to a variety of closing means, including, in addition to sewing, heat sealing, resin bonding such as, for example, with use of hot-melt adhesive, and stapling. It is within the spirit and scope of the invention to heat-shrink the wrapper into close conformity to the bale surfaces where advantage is seen in so doing. It will also be apparent that apparatus other than that described can be used to wrap the bale and to form and close the flanges and that bales of any desired shape, including cylindrical, can be wrapped by the process of this invention to provide neat, durable packages.

What is claimed is:

1. A process for covering a strapped bale with a fabric comprising: wrapping the fabric around four faces of the bale; clamping the fabric ends together to form a tube with at least one side flange extending outwardly from the bale, the tube extending beyond the unwrapped faces of the bale; sewing the side flanges together; tucking opposite ends of the tube having side flanges extending beyond the bale against the unwrapped faces of the bale to form side tucks; folding the opposite remaining portions of the extended tube lengths together to form end flanges while holding the side tucks in place, the portion of said side flanges extending beyond the bale being tucked between said end flanges and said unwrapped faces of the bale; and sewing the end flanges together.

2. A process for covering a strapped bale comprising: extending two parallel sheets of nonwoven fabric above and below the bale; clamping the fabrics together to snug them around the bale in the form of a tube with side flanges extended from opposite sides of the bale; sewing the side flanges together to form a tube with open ends extending beyond opposite ends of the bale; tucking opposite ends of the extending tube lengths having side flanges against the ends of the bale to form side tucks; folding the opposite remaining portions of the extended tube lengths together to form end flanges extending from opposite ends of the bale while holding said side tucks in place, said side tucks being between said end flanges and said ends of the bale; and sewing the end flanges together.

* * * * *